US010041495B2

(12) United States Patent
Robillard

(10) Patent No.: US 10,041,495 B2
(45) Date of Patent: Aug. 7, 2018

(54) HIGH VOLUME VACUUM PUMP FOR CONTINUOUS OPERATION

(71) Applicant: Clay Valley Holdings Inc., Amprior (CA)

(72) Inventor: Bruce Robillard, Amprior (CA)

(73) Assignee: Clay Valley Holdings Inc., Amprior (CA)

( * ) Notice: Subject to any disclaimer, the term of this patent is extended or adjusted under 35 U.S.C. 154(b) by 430 days.

(21) Appl. No.: 14/959,022

(22) Filed: Dec. 4, 2015

(65) Prior Publication Data

US 2017/0159659 A1 Jun. 8, 2017

(51) Int. Cl.

| | |
|---|---|
| ***F04C 18/34*** | (2006.01) |
| ***F04C 25/02*** | (2006.01) |
| ***F04C 18/344*** | (2006.01) |
| ***F04C 29/00*** | (2006.01) |
| ***F04C 29/04*** | (2006.01) |
| ***F04C 29/12*** | (2006.01) |

(52) U.S. Cl.

CPC ..... *F04C 25/02* (2013.01); *F04C 18/344* (2013.01); *F04C 29/0085* (2013.01); *F04C 29/0092* (2013.01); *F04C 29/047* (2013.01); *F04C 29/124* (2013.01); *F04C 2240/30* (2013.01); *F04C 2240/40* (2013.01); *F04C 2240/60* (2013.01); *F04C 2240/808* (2013.01)

(58) Field of Classification Search

CPC .. F04B 37/14; F04C 18/3441; F04C 18/3448; F04C 18/356; F04C 18/3564

See application file for complete search history.

(56) References Cited

U.S. PATENT DOCUMENTS

| | | | | |
|---|---|---|---|---|
| 3,963,023 A * | 6/1976 | Hankinson | F04B 43/1253 | 417/477.11 |
| 6,059,544 A * | 5/2000 | Jung | A61M 1/0058 | 417/477.2 |
| 6,123,516 A * | 9/2000 | Burghard | F04B 25/00 | 417/250 |
| 7,273,359 B2 * | 9/2007 | Blight | A61M 3/0258 | 417/44.2 |

(Continued)

FOREIGN PATENT DOCUMENTS

WO WO 2014077308 A1 * 5/2014 ..... F04B 43/08

*Primary Examiner* — Patrick Hamo

(74) *Attorney, Agent, or Firm* — Timothy W. Menasco, Esq.; Harter Secrest & Emery LLP

(57) ABSTRACT

In at least one embodiment the present invention provides a vacuum pump assembly having a vacuum pump body defining a cylindrical internal pump chamber housing a rotary vane rotatable about an axis radially removed from the center of the cylindrical internal pump chamber, an inlet, at least one outlet, a rotary power source abutting the vacuum pump body and having a proximal surface fluidly communicating with the internal pump chamber by way of the at least one outlet; the rotary power source having a rotating shaft operably connected to the rotary vane, and an electronics housing positioned adjacent the vacuum pump body such that as the rotary vane is rotated a first abbreviated crescent shaped working space is defined in communication with the inlet and as the rotary vane continues to rotate a second abbreviated crescent shaped working space is defined in communication with the at least one outlet.

25 Claims, 5 Drawing Sheets

(56) References Cited

U.S. PATENT DOCUMENTS

| | | | | |
|---|---|---|---|---|
| 7,727,176 | B2 * | 6/2010 | Tonelli | A61M 1/16 137/861 |
| 7,798,996 | B1 * | 9/2010 | Haddad | A61M 5/16831 417/477.2 |
| 7,934,912 | B2 * | 5/2011 | Voltenburg, Jr. | A61M 5/14232 417/477.11 |
| 8,308,457 | B2 * | 11/2012 | Rotem | A61M 5/14228 417/479 |
| 8,353,683 | B2 * | 1/2013 | Miyazaki | F04B 19/006 417/360 |
| 8,784,359 | B2 * | 7/2014 | Plahey | A61M 1/28 417/395 |
| 9,388,803 | B2 * | 7/2016 | Schaefer | F04B 43/08 |
| 9,468,716 | B2 * | 10/2016 | Hariharesan | A61M 5/14232 |
| 2007/0269324 | A1 * | 11/2007 | Goldor | A61M 5/14228 417/474 |
| 2008/0028730 | A1 * | 2/2008 | Savicki | B65B 31/047 53/434 |
| 2011/0300010 | A1 * | 12/2011 | Jarnagin | A61B 17/3207 417/477.2 |
| 2011/0313358 | A1 * | 12/2011 | Hariharesan | A61M 5/14228 604/151 |
| 2012/0082576 | A1 * | 4/2012 | Beck | F04B 43/0081 417/474 |
| 2013/0139472 | A1 * | 6/2013 | Borchardt | B65B 31/042 53/432 |
| 2015/0204321 | A1 * | 7/2015 | Schnekenburger | F04B 43/1276 417/477.2 |
| 2015/0285404 | A1 * | 10/2015 | Koyama | F04B 43/12 248/74.2 |
| 2017/0284394 | A1 * | 10/2017 | Muller | F04C 25/02 |

* cited by examiner 14
12
12
30
30
31
31
33
33
35
35
40
40
42
42
42
44
46
46
50
50
52
54
54
56
58
58
59
70
80
82
82
82
82
82
90
90

HIGH VOLUME VACUUM PUMP FOR CONTINUOUS OPERATION

FIELD

The present invention relates to vacuum pumps. More specifically, the present, invention relates to an improved vacuum pump that is adapted for high volume, efficient and continuous operation, is easily installed and adapted for use in tight physical spaces, such as automotive applications.

BACKGROUND

In a variety of industrial situations it is required to pump gases in order to achieve particular working results. As will be readily appreciated by the skilled person, pumping gases requires special considerations given that a significant proportion of known pump technology was developed for use in connection with liquids that are incompressible for practical purposes.

One such approach to this problem has been the development of vacuum pumps that can lower the internal pressure of the working space by evacuating gases from that working space.

One common type of vacuum pump that has been developed for evacuating gas from a working space is a rotary vane pump that consists of an eccentrically mounted, rotary vane received in an internal pump cavity that has a number of outwardly projecting slots that each slidably receive a vane. In this way, as the rotary hub is rotated, centrifugal force causes the vanes to slide outwardly along the projecting, slots in order to abut the inner surface of the internal pump cavity, creating a gas seal between the vane and the inner surface. As the rotary vane rotates a working space is temporarily created adjacent an orifice, and the compression and expansion of this working space generates a pumping action that is suitable for pumping the gas to (or, in some cases, from) the orifice positioned adjacent the working space.

However, since gases are highly compressible when used as a working fluid it will be readily appreciated that rotary vane vacuum pumps must operate at high rotational speeds and for extended periods (if not continuously) when maintaining a vacuum in an industrial application. These operating conditions can place significant demands on the equipment used to power the pump, which is often an electric motor.

Moreover, in some applications, installation space is limited and therefore it is desirable to include all required hardware (both mechanical and electronic) in a single piece of equipment in order to simplify and streamline the installation of the vacuum pump and minimize the space required for the vacuum pump and all attendant hardware that is required, which of course will depend on the end user application.

Accordingly, there is need for an improved vacuum pump that is robust, adapted for high volume, efficient and continuous operation, is easily installed and adapted for use and installation in restricted spaces.

BRIEF SUMMARY

In at least one embodiment, it is contemplated that the present invention provides an improved vacuum pump that is robust, adapted for high volume, efficient and continuous operation, is easily installed and adapted for use and installation in restricted spaces.

In at least one embodiment, a vacuum pump assembly is provided having a vacuum pump body, the vacuum pump body defining a cylindrical internal pump chamber having a first circular wall and an opposed second circular wall separated by an axial width and an internal circumferential surface, the vacuum pump body defining a second internal cavity adjacent the cylindrical internal pump chamber, the vacuum pump body having a shaft bore extending between the cylindrical internal pump chamber and the second internal cavity, a rotary vane having a cylindrical hub having an axial width and a plurality of outwardly projecting slots, each of the plurality of outwardly projecting slots slidably receiving a corresponding one of a plurality of vanes, each of the plurality of vanes having a distal leading edge having the same width as the axial width of the cylindrical internal pump chamber and the axial width of the rotary vane, the rotary vane rotatable about a rotation axis that is radially removed from the central axis of the cylindrical internal pump chamber, an inlet, the inlet including a check valve and fluidly communicating with the cylindrical internal pump chamber, at least one outlet, the at least one outlet connecting the cylindrical internal pump chamber in fluid communication with the second internal cavity, a rotary power source abutting the vacuum pump body and fluidly communicating with the second internal chamber by way of a cooling space defined between the vacuum pump body and the rotary power source; the rotary power source having a rotating shaft, the rotating shaft extending along the rotation axis and received in the shaft bore and operably connected to the rotary vane, an exhaust orifice, the exhaust orifice extending through the vacuum pump body and connecting the cooling space and the external environment in fluid communication, and an electronics housing positioned adjacent the vacuum pump body such that as the rotary vane is rotated a first of the plurality of vanes extends outwardly under centrifugal acceleration such that the distal leading edge of a first of the plurality of vanes abuts the internal circumferential surface of the internal pump chamber thereby dividing the internal pump chamber into a first abbreviated crescent shaped working space in communication with the inlet and as the rotary vane continues to rotate a second of the plurality of vanes extends outwardly under centrifugal acceleration such that the distal leading edge of the second of the plurality of vanes abuts the internal circumferential surface of the internal pump chamber and the internal pump chamber is subsequently divided into a second abbreviated crescent shaped working space defined between the first of the plurality of vanes and the second of the plurality of vanes, the at least one outlet fluidly communicating with the second abbreviated crescent shaped working space.

BRIEF DESCRIPTION OF THE DRAWINGS

The present invention will be better understood in connection with the following Figures, in which.

DETAILED DESCRIPTION OF THE EMBODIMENTS

Figure 1:
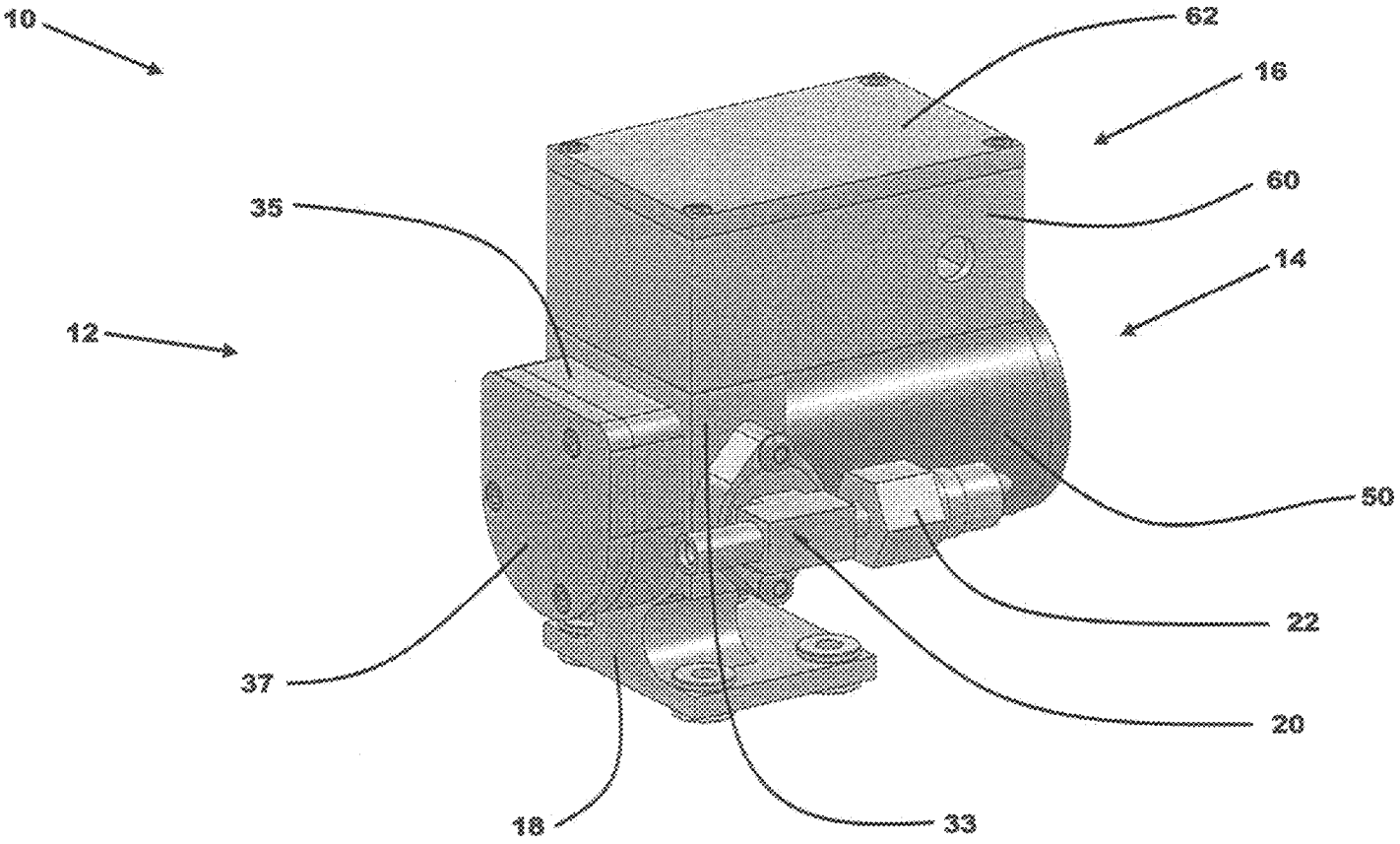
FIG. 1 is an isometric view of an assembled vacuum pump assembly in accordance with at least one embodiment of the present invention.

It is contemplated that the present invention provides a vacuum pump assembly that is robust, adapted for high volume, efficient and continuous operation, is easily installed and adapted for use and installation in restricted spaces.

In at least one embodiment, a vacuum pump assembly is provided that has a vacuum pump body, a rotary power source and an electronics housing.

It will be readily understood by the skilled person that all components discussed herein can be formed of any suitable material (such as, but not limited to, steel, aluminum and composite materials), in any suitable dimensions and by any suitable manufacturing process (such as, but not limited to, milling, casting and 3D-printing). Further, it is contemplated that all components discussed herein can be formed of a single, unitary component or alternatively can be formed of multiple, separate components joined together by suitable means, such as but not limited to welding, mechanical fastening, interference fits and chemical adhesives.

It is further contemplated that the present vacuum pump assembly can be used in a nearly limitless number of applications where it is required to pump gases or create a vacuum. In at least one embodiment, it is contemplated that the present vacuum pump assembly can be used as a brake boosting vacuum pump in automotive applications.

In at least one embodiment, the vacuum pump body defines an internal pump chamber that has an inlet and at least one outlet. In at least one embodiment the internal pump chamber is cylindrical and is defined by an internal circumferential surface, a first circular wall and an opposed, second circular wall separated by axial width. In at least one embodiment the inlet and the at least one outlet are located in one of the first circular wall and the second circular wall, however other arrangements are also contemplated.

It is contemplated that in at least one embodiment the inlet can further include a check valve that only permits flow into the internal pump chamber, thereby limiting any back pressure generated by the pump escaping through the inlet. Moreover, it is contemplated that the inlet can include a mechanical filter to permit any particulate being introduced into the internal pump chamber. Further, it is contemplated that the inlet can further include an electric valve/solenoid and/or a vacuum switch for regulating the operation of the inlet, as will be readily understood by the skilled person.

The internal pump chamber rotatably houses a cylindrical rotary vane having a cylindrical hub having an axial width. In at least one embodiment, it is contemplated that the cylindrical hub has an axial width that is substantially the same as the axial width of the internal pump chamber. In at least one embodiment, it is contemplated that the rotary vane rotates about a rotational axis that is laterally removed from the geometric central axis of the cylindrical internal pump chamber. In this way, it will be understood that the rotary vane is eccentrically mounted within the internal pump chamber.

Figure 4:
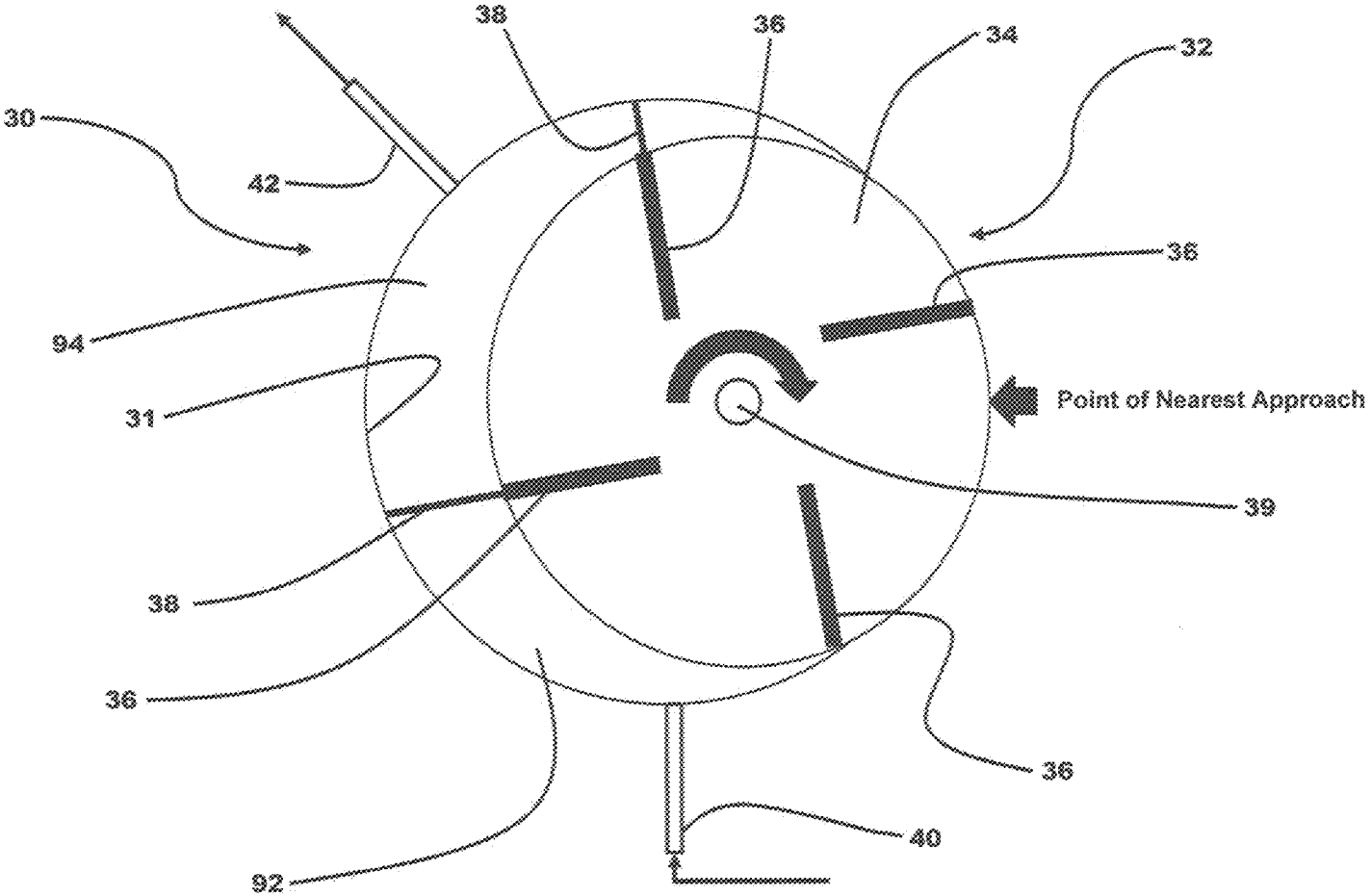
FIG. 4 is an illustration of the operation of a rotary vane and internal pump chamber in accordance with at least one embodiment of the present invention.

In at least one embodiment, it is contemplated that as the rotary vane is eccentrically mounted within the internal pump chamber the cylindrical hub of the rotary vane substantially approaches the internal circumferential surface of the internal pump chamber at a single, nearly coincident point on the outer circumference of the cylindrical hub and the circumference of the internal circumferential surface of the internal pump chamber when the present vacuum pump assembly is installed, as can be seen in FIG. 4 and as will be discussed in further detail below.

It is contemplated that the cylindrical hub has a number of outwardly projecting slots that axially extend entirely through the axial width of the rotary vane. In some embodiments these slots are radially oriented and in other embodiments these slots are oriented in a plane that is laterally removed from the radius (as can be seen in FIG. 4), or in other words an abbreviated or partial chord, as will be readily appreciated by the skilled person, among other arrangements that will also be appreciated by the skilled person.

It is further contemplated that each slot in the cylindrical hub slidably receives a vane. In at least one embodiment the vane is generally rectangular in shape and has the substantially the same width as the axial width of the cylindrical hub of the rotary vane. Further, each vane has a distally oriented leading edge that shares substantially the same width as the rest of the vane, the cylindrical hub and internal pump chamber. It is contemplated that the vane can be formed of any suitable material, however it will be readily appreciated that a preferred material will be sufficiently strong yet wear in a low friction manner given the operational demands of the vane, as discussed in further detail below.

In this way, and given that the rotary vane is eccentrically mounted within the internal pump chamber as discussed above, as the rotary vane is rotated about its axis, the vanes will extend outwardly under centrifugal acceleration such that the leading edge of each vane abuts the internal circumferential surface of the internal pump chamber. However, since the rotary hub is eccentrically oriented such that the cylindrical hub substantially approaches the internal circumferential surface of the internal pump chamber at a single, nearly coincident point on the circumference of the cylindrical hub and the circumference of the internal circumferential surface of the internal pump chamber, the vanes will slidably retract into and out of the slots depending on the rotational position of the rotary vane relative to the internal pump chamber, as discussed in further detail below in relation to FIG. 4.

Therefore and as will be understood by the skilled person, as the rotary vane rotates a first vane will extend outwardly from its respective slot such that its respective leading edge abuts the internal circumferential surface of the internal pump chamber in order to define a first, abbreviated crescent shaped space in the annular space between the cylindrical hub of the rotary vane and the internal circumferential wall of the internal pump chamber.

As the rotary vane continues to rotate, the first vane will continue to extend from its respective slot and the respective leading edge will continue to contact the internal circumferential surface of the internal pump chamber while a second, subsequent vane will extend outwardly from its respective slot such that its respective leading edge abuts the internal circumferential surface of the internal pump chamber in order to define a second, abbreviated crescent shaped space between the first vane and the second vane in the annular space between cylindrical hub of the rotary vane and the internal circumferential surface of the internal pump chamber.

In at least one embodiment, it is contemplated that the inlet is in communication with the first, abbreviated crescent shaped space and the at least one outlet is in fluid communication with the second, abbreviated crescent shaped space. In this way and as will be understood by the skilled person, in this arrangement the inlet is never directly in fluid communication with the at least one outlet as these two chambers are always separated by an outwardly projecting vane that is continually replaced and maintained in contact with the internal circumferential surface of the internal pump chamber as the rotary vane rotates.

Moreover and as will be understood by the skilled person, the second vane also creates an abbreviated crescent shaped space that is analogous to the first, abbreviated crescent shaped space in the annular space between the rotary vane and the internal pump chamber as discussed above. In this way, as the rotary vane continues to rotate the first, abbreviated crescent shaped space is continually expanded and the second, abbreviated crescent shaped space is continually collapsed, thereby creating a pumping action that can move gas from a first location (for example, the inlet) to a second location (for example, the at least one outlet). Accordingly, a low pressure situation can be created in a system in fluid communication with the inlet as gas can be evacuated from the system through the pumping action of the present vacuum pump assembly.

As will be readily appreciated by the skilled person, the rotary vane is rotated by a rotary power source that is affixed to the vacuum pump body at an adjacent location. In at least one embodiment, it is contemplated that the rotary power source has a rotating shaft that is affixed to the cylindrical hub of the rotary vane. In at least one embodiment, the rotating shaft is received in a bore provided in the vacuum pump body that is located at coincident position as the rotational axis of the rotary vane, as will be readily understood by the skilled person.

It is contemplated that the rotary power source is in fluid communication with the internal pump chamber through the at least one outlet, as will be discussed in further detail below. It is also contemplated that in some embodiments, the rotary power source can include a proximal surface having a cooling port that fluidly communicates with the internal structure of the rotary power source, among other arrangements that will be readily appreciated by the skilled person.

In some embodiments, it is contemplated that the proximal end of the rotary power source further includes a raised perimeter rim having an internal circumferential wall abuts the vacuum pump body when the vacuum pump assembly is fully assembled. In this way, it is contemplated that the raised perimeter rim and the internal circumferential wall define an interior cooling space that can fluidly communicate with both the internal pump chamber and the rotary power source as will be discussed in further detail below.

In at least one embodiment, it is contemplated that the rotary power source is an electric motor, however other arrangements are also contemplated. In embodiments where the rotary power source is an electric motor it is contemplated that the electronics equipment related to the operation of the electric motor (including but not limited to any control circuits, switches, relays, instruments panels and terminal blocks) can be included in the electronics housing as required by the particular end user application of the present invention.

In some embodiments, it is contemplated that the vacuum pump body further includes a second internal chamber that is adjacent to and in fluid communication with the internal pump chamber through at least one outlet. In these embodiments it is contemplated that the second internal chamber fluidly communicates with the internal pump chamber through the at least one outlet, however other arrangements are also contemplated. In some embodiments it is contemplated that the second internal chamber is generally cylindrical in shape however other arrangements are also contemplated.

In at least one embodiment, it is contemplated that the vacuum pump body further includes an exhaust port in communication with at least one of the at least one of the second internal chamber and the cooling space. In this way, pressurized gas can flow from the internal pump chamber through the at least one outlet to the second internal chamber, and from the second internal chamber (or alternatively the cooling space) to the exhaust port. In some embodiments, the exhaust port is simply in communication with the external environment however, other arrangements are also contemplated as required by the particular end user application of the present invention.

In some embodiments, it is contemplated that the vacuum pump body can further include a mounting surface for mounting the rotary power source to the vacuum pump body. In these embodiments, it is further contemplated that the mounting surface can further include at least one recirculation port that is in fluid communication with the second internal chamber. It is also contemplated that in some embodiments the at least one recirculation port is in fluid communication with the cooling space defined between the vacuum pump body and the rotary power source. In some embodiments, it is contemplated that the exhaust port is located on the mounting surface, and in these embodiments the exhaust port is in fluid communication with the cooling space.

In this way, in these embodiments it is contemplated that pressurized gas from the internal pump chamber can flow from the internal pump chamber to the second internal chamber through the at least one outlet, and from the second internal chamber to the cooling space defined between the vacuum pump body and the rotary power source. In some embodiments, pressurized gas can recirculate from the second internal chamber to the cooling space through at least one recirculation port, however other arrangements are also contemplated.

Further, in some embodiments the cooling space can further fluidly communicate with the internal structure of the rotary power source through at least one cooling port provided in a proximal surface of the rotary power source. In other embodiments, there is no proximal surface and the cooling space is in direct communication with the internal structure of the rotary power source. Further, it is contemplated that the cooling space can fluidly communicate with an exhaust port located in the vacuum pump body, which in turn fluidly communicates with the environment.

In this way, it is contemplated that pressurized gas generated by the vacuum pump can flow from the internal pump chamber through the second internal chamber of the vacuum pump body to the cooling space in fluid communication with the rotary power source and from the rotary power source through the cooling space to the exhaust port. Accordingly, heat generated by the rotary power source can be transferred away from the rotary power source to the external atmosphere thereby cooling the rotary power source during continual operation, such as embodiments where the present invention is used as a brake booster in automotive applications.

It is also contemplated that the present vacuum pump assembly includes an electronics housing. The electronics housing can house any type of suitable equipment for use in connection with the present invention including but not limited to a control panel for an electric motor, any suitable instrument panels, a control panel for the inlet valve, any suitable relays and fuses, and a terminal block for connecting equipment to a power source. It is contemplated that in at least one embodiment the electronics housing is enclosed and provides sufficient protection from moisture, physical shock, dust and other environmental pollutants, as will be readily appreciated by the skilled person.

Figure 2:
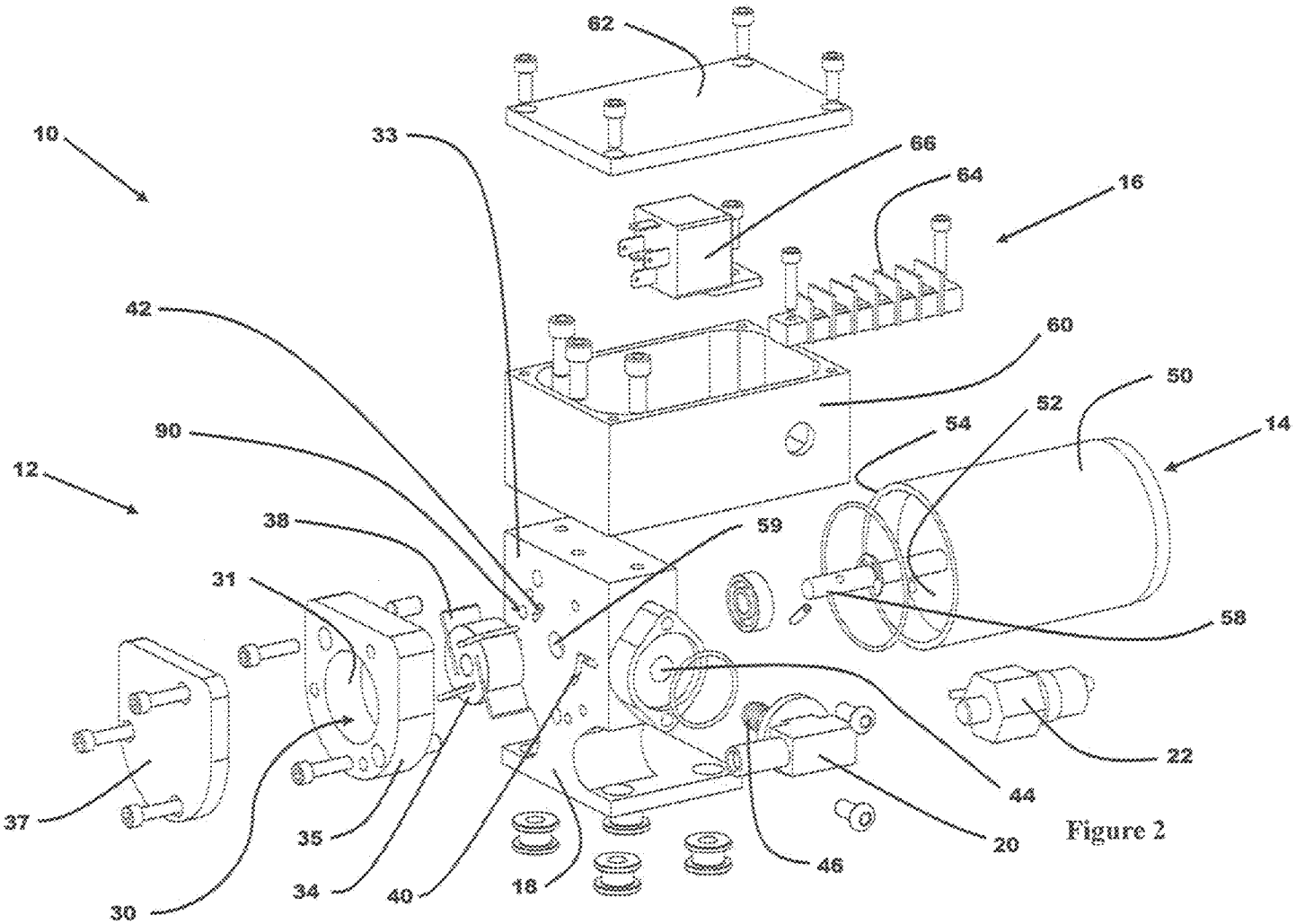
FIG. 2 is an isometric exploded view of the vacuum pump assembly shown in FIG. 1.
Figure 5:
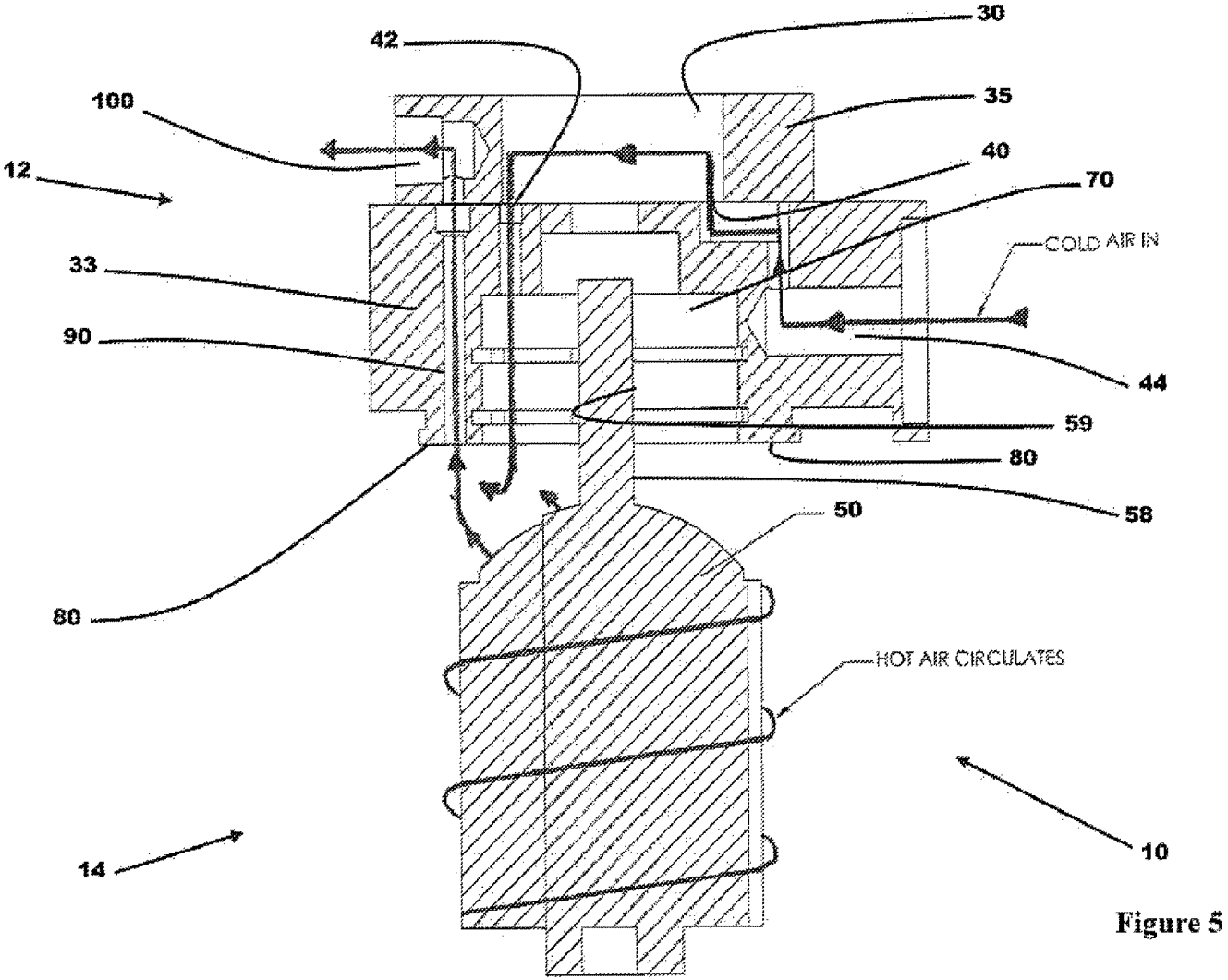
FIG. 5 is cross sectional, top view of at least one embodiment of an assembled vacuum pump assembly.

Turning to FIGS. 1, 2 and 5, at least one embodiment of the present vacuum pump assembly 10 is illustrated having a vacuum pump body 12, a rotary power source 14 and an electronics housing 16. In this embodiment it can be seen that vacuum pump assembly 10 also optionally includes a mounting pedestal 18, an electric inlet valve 20 and a vacuum switch 22.

As can be seen in FIGS. 2, 4 and 5, vacuum pump body 12 houses an internal pump chamber 30 having a first circular wall, a second circular wall (both not shown) and an internal circumferential surface 31 and which rotatably receives a rotary vane 32. In this embodiment rotary vane 32 has a cylindrical hub 34 that includes a number of outwardly projecting slots 36 that each slidably receives a vane 38. In this embodiment, vacuum pump body 12 is constructed of a main pump body 33 (which defines one of the first and second circular wall), a sleeve 35 and a cover 37 (which defines the other of the first and second circular wall) however other arrangements are also contemplated as discussed above.

As discussed above, hi this embodiment it is contemplated that each slot 36 in cylindrical hub 34 slidably receives vane 38. In at least one embodiment vane 38 is generally rectangular in shape and has the substantially the same width as the cylindrical hub 34 of rotary vane 32. Further, each vane 38 has a distally oriented leading edge that shares substantially the same width as the rest of the vane 38, the axial width of cylindrical hub 34 and the axial width of internal pump chamber 30.

In this way, and given that rotary vane 32 is eccentrically mounted within the internal pump chamber 30 as depicted in FIG. 4, as the rotary vane 32 is rotated about its axis 39, vane 38 will extend outwardly under centrifugal acceleration such that the leading edge of each vane 38 abuts the internal circumferential surface 31 of internal pump chamber 30. However, since the rotary hub 32 is eccentrically oriented such that the cylindrical hub 34 substantially approaches the internal circumferential surface 31 of the internal pump chamber 30 at a single, nearly coincident point on the circumference of the cylindrical hub 32 and the circumference of the internal circumferential surface 31 of the internal pump chamber 30, vane 38 will slidably retract into and out of slot 36 depending on the rotational position of the rotary vane 32 relative to the internal pump chamber 30.

Figures 3A, 3B:
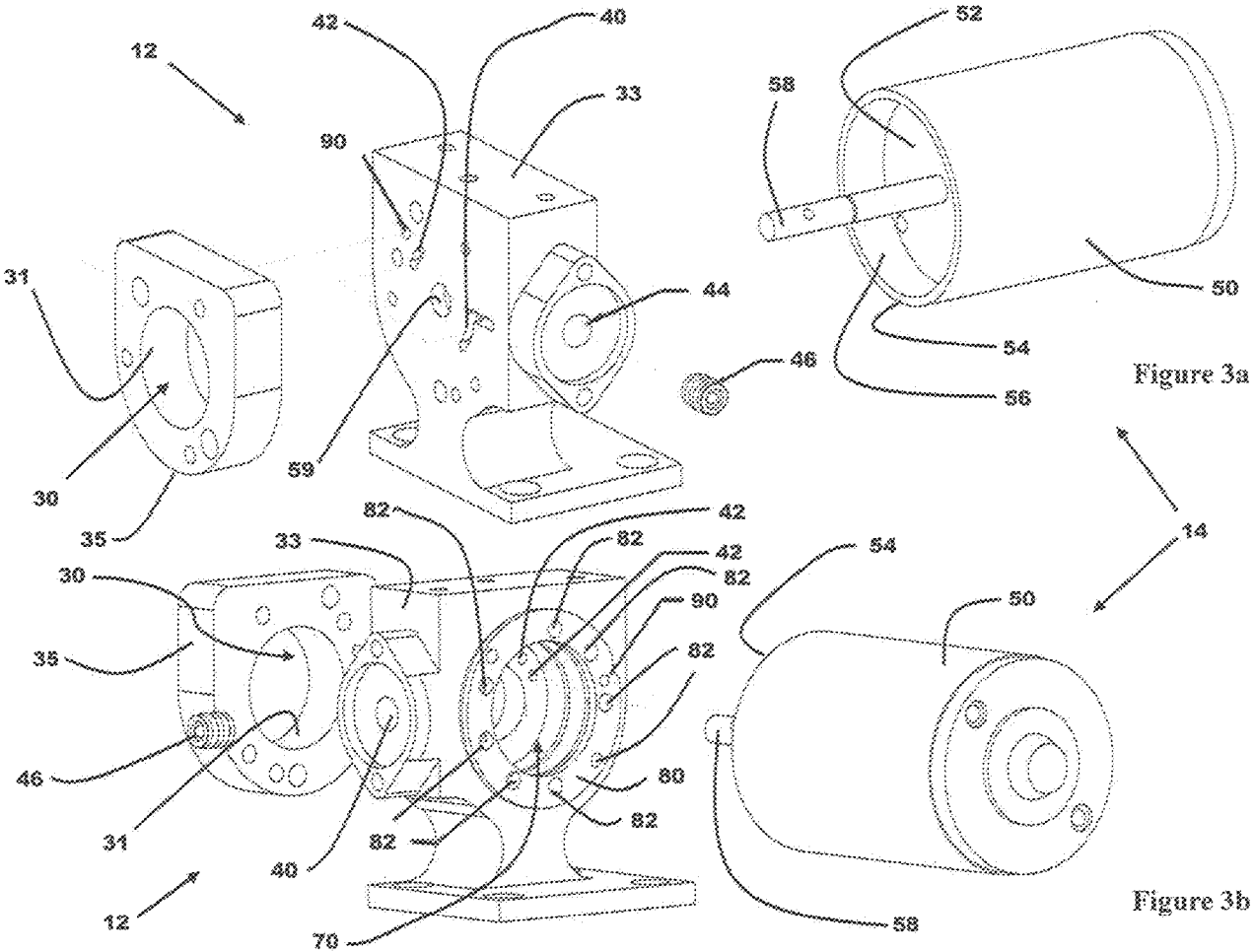
FIG. 3*a* is a partially exploded left isometric view of the vacuum pump body and rotary power source of the vacuum pump assembly shown in FIG. 1.
FIG. 3*b* is a partially exploded right isometric view of the vacuum pump body and rotary power source of the vacuum pump assembly shown in FIG. 1.

In this embodiment it is contemplated that internal pump chamber 30 has an inlet and at least one outlet. In this embodiment, the inlet includes an inlet orifice 40 that fluidly communicates with an external inlet port 44, which can house a check valve 46 in order to prevent fluid flow from internal pump chamber 30 through the inlet. In some embodiments it is contemplated that the inlet orifice 40 is in fact an inlet orifice groove located in the first or second circular wall of the internal pump chamber 30, as seen in FIGS. 2 and 3*a*, however other arrangements are also contemplated. Further, in some embodiments an electric inlet valve 20 and a vacuum switch 22 can be provided to control the operation of the inlet. It is also contemplated that the inlet can include a filter (not shown).

Moreover, in this embodiment the at least one outlet is a plurality of outlet orifices 42 that fluidly communicate with a second internal chamber, as will be discussed in further detail below in connection with FIGS. 3*b* and 5.

As discussed above, a rotary power source 14 is provided that in this embodiment is an electric motor 50. In this embodiment, electric motor 50 has a proximal surface 52 and a raised perimeter rim 54 with an internal circumferential wall 56. In other embodiments and as can be seen in FIG. 5, there is no proximal surface and the internal armature of the electric motor 50 is in direct fluid communication with the cooling space, as discussed below.

In this way, the raised perimeter rim 54 abuts the vacuum pump body 12 when the vacuum pump assembly is assembled and creates a cooling space defined by the internal circumferential wall 56 of raised perimeter rim 54 between the main pump body 33 and the electric motor 50. Further, electric motor 50 has a rotating shaft 58 that is rotatably received in a shaft bore 59 provided in pump vacuum body 12 and operably linked to cylindrical hub 34 of rotary vane 32. Moreover, in some embodiments a cooling port 57 may be provided on proximal surface 52 to allow gas flow from the cooling space to the internal armature components of the electric motor 60. However, and as discussed above, in some embodiments there is no proximal surface 52 and the internal armature components are in direct fluid communication with the cooling space.

As also discussed above, vacuum pump assembly 10 further includes an electronics housing 16 that in this embodiment includes a perimeter wall 60, an access lid 62 and which can optionally house a terminal block 64 and a relay 66, however other electronics equipment can also be housed in electronics housing 16 as will be readily appreciated by the skilled person.

Turning to FIGS. 3*a*, 3*b* and 6, a partial, exploded view of a vacuum pump body 12 and rotary power source 14 is illustrated according to at least one embodiment of the present invention. In this embodiment, main pump body 33 of vacuum pump body 12 further defines a second internal chamber 70 that is positioned adjacent to internal pump chamber 30 which, as discussed above, has an internal circumferential surface 31 and is defined by main pump body 33, sleeve 35 and cover (not shown).

In this embodiment, second internal chamber 70 is in fluid communication with internal pump chamber 30 by way of two outlet ports 42. Moreover, vacuum pump body 12 further comprises a mounting surface 80 that abuts perimeter rim 54 of electric motor 50 when the vacuum pump assembly is installed. Also, mounting surface 80 further contains a plurality of recirculation ports 82 that fluidly communicate with the second internal space 70 and the cooling space defined by proximal surface 52 of the electric motor 50 and internal circumferential wall 56 of raised perimeter rim 54 of electric motor 50 (as seen in FIG. 3*a*). In this embodiment, it is contemplated that recirculation ports 82 fluidly communicate with the second internal space 70 by way of a plurality of corresponding orifices (not shown) provided in the internal wall of the second internal space 70, however other arrangements are also contemplated as will be readily appreciated by the skilled person.

Finally, in this embodiment main pump body 33 of vacuum pump body 12 includes an exhaust port 90 that fluidly communicates with the external environment by way of an external exhaust orifice 100, as can be seen in FIG. 5. In this embodiment, exhaust port 90 is located on mounting surface 80 and is ducted through main pump body 33 to an external exhaust orifice located on the sleeve 35, however this is only one way in which it is contemplated that exhaust port 90 can be oriented, as will be readily understood by the skilled person.

With specific reference to FIG. 5, the fluid path through the vacuum pump assembly 10 is illustrated. In this embodiment, cold aft enters to the internal pump chamber 30 through the external inlet port 44 of inlet orifice 40. The cold inlet air is compressed in internal pump chamber 30 (as discussed below in greater detail) and evacuated through at least one outlet port 42 to an adjacent, second internal chamber 70. The pressurized, cold air is then subsequently directed from the second internal chamber 70 such that it can fluidly communicate with the internal armature mechanism of the electric motor 50.

In this embodiment, the pressurized, cold air is directed directly from the second internal chamber 70 to the internal armature mechanism of the electric motor 50 in order to provide a cooling function, however and as discussed herein, it is contemplated that alternate arrangements can be employed including but not limited to recirculation ports located in the main pump body 33, as seen in FIG. 3*b*. Moreover, in some embodiments it is contemplated that electric motor 50 can include a proximal surface 52 that has a cooling port 57 (as seen in FIG. 3*a*) that fluidly communicates with the internal armature mechanism of the electric motor 50, among other arrangements that will be readily understood by the skilled person.

As will be readily understood by the skilled person and as discussed above, an electric motor generates heat as it operates. Therefore, as the compressed air circulates about the internal armature mechanism of the electric motor 50 heat is transferred from the internal armature mechanism to the circulating air. This warmed air is then exhausted out exhaust port 90 (which is located in the mounting surface 80 and extends through main pump body 33) of the vacuum pump body 12. In this way, the warmed air can exit through the exhaust port 90 and out external exhaust orifice 100.

In this way and turning back to FIG. 4, as the rotary vane 32 rotates a first vane of the plurality of vanes 38 will extend outwardly from its respective slot 36 such that its respective leading edge abuts the internal circumferential surface 31 of the internal pump chamber 30 in order to define a first, abbreviated crescent shaped space 92 in the annular space between the cylindrical hub 34 of the rotary vane 32 and the internal circumferential wall 31 of the internal pump chamber 30. In this embodiment the rotary vane 32 is depicted as rotating clockwise however other arrangements will be readily contemplated by the skilled person.

As the rotary vane 32 continues to rotate, the first vane of the plurality of vanes 38 will continue to extend from its respective slot 36 and the respective leading edge will continue to contact the internal circumferential surface 31 of the internal pump chamber 30 while a second, subsequent vane of the plurality of vanes 38 will extend outwardly from its respective slot 38 such that its respective leading edge abuts the internal circumferential surface 31 of the internal pump chamber 30 in order to define a second, abbreviated crescent shaped space 94 between the first vane and the second vane in the annular space and between the cylindrical hub 34 of the rotary vane 32 and the internal circumferential surface 31 of the internal pump chamber 30.

In this embodiment, it is contemplated that the inlet orifice 40 of the inlet is in communication with the first, abbreviated crescent shaped space 92 and the two outlet orifices 42 of the at least one outlet is in fluid communication with the second, abbreviated crescent shaped space 94. In this way and as will be understood by the skilled person, the inlet orifice 40 is never directly in fluid communication with the two outlet orifices 42 as these two sets of orifices are always separated by an outwardly projecting vane that is continually replaced and maintained in contact with the internal circumferential surface 31 of the internal pump chamber 30 as the rotary vane 32 rotates, as can be seen in FIG. 4.

Moreover and as will be understood by the skilled person, as the rotary vane rotates the second, subsequent vane of the plurality of vanes 38 also creates an abbreviated crescent shaped space that is analogous to the first, abbreviated crescent shaped space 92 in the annular space between the cylindrical hub 34 of the rotary vane 32 and the internal circumferential surface of the internal pump chamber 30 as discussed above.

In this way, as the rotary vane continues to rotate the first, abbreviated crescent shaped space 92 is continually expanded and the second, abbreviated crescent shaped space is continually collapsed 94, thereby creating a pumping action that can move gas from the inlet orifice 40 to the outlet orifices 42. Moreover, given that the inlet can include a check valve 46, it is contemplated that gas cannot escape from internal pump chamber 30 back through the inlet, thereby assisting with the efficiency of operation. Accordingly, gas can be drawn out of a system fluidly communicating with the inlet through the pumping action of the present vacuum pump assembly 10.

In this way and as can be seen in FIG. 5, in this embodiment it is contemplated that pressurized gas from the internal pump chamber 30 can flow from the internal pump chamber 30 through outlet orifices 42 to the second internal chamber 70, and from the second internal chamber 70 to the cooling space (defined by proximal surface 52 and internal circumferential wall 56 of raised perimeter rim 54 of electric motor 50) through recirculation ports 82. Further, in this embodiment the cooling space can further fluidly communicate with the internal armature structure of the electric motor 50 through the cooling port 57 provided in the proximal surface 52 of the electric motor. Moreover, it is contemplated that the cooling port 57 can fluidly communicate with the exhaust port 90 to exhaust gases to the atmosphere.

In this way, it is contemplated that pressurized gas generated by the vacuum pump can flow through the internal pump chamber 30 of the vacuum pump body to the electric motor (through the outlets 42, second internal chamber 70, recirculation ports 82 and cooling space) and from the electric motor 50 to the exhaust port 90 (through the cooling space) and accordingly heat generated by the electric motor can be transferred out of the vacuum pump assembly 10 to the external atmosphere thereby cooling electric motor 50 during continual operation, such as embodiments where the present invention is used as a brake booster in automotive applications.

The skilled person will readily appreciate that the present embodiments discussed herein are introduced for exemplary purposes only and the protection sought will be limited only by the scope of the attached claims.

I claim:

1. A vacuum pump assembly comprising:

a) A vacuum pump body, the vacuum pump body defining a cylindrical internal pump chamber having a first circular wall and an opposed second circular wall separated by an axial width and an internal circumferential surface;

b) A rotary vane having a cylindrical hub having an axial width and a plurality of outwardly projecting slots, each of the plurality of outwardly projecting slots slidably receiving a corresponding one of a plurality of vanes, each of the plurality of vanes having a distal leading edge having substantially the same width as the axial width of the internal pump chamber and the axial width of the rotary vane, the rotary vane rotatable about a rotation axis radially removed from the centre of the cylindrical internal pump chamber;

c) An inlet in fluid communication with the cylindrical internal pump chamber;

d) At least one outlet in fluid communication with the cylindrical internal pump chamber;

e) A rotary power source abutting the vacuum pump body and fluidly communicating with the cylindrical internal pump chamber of a cooling space defined between the rotary power source and the vacuum pump body, the cooling space fluidly communicating with the cylindrical internal pump chamber by way of the at least one outlet; the rotary power source having a rotating shaft, the rotating shaft extending along the rotation axis and operably connected to the rotary vane;

f) An electronics housing positioned adjacent the vacuum pump body; and g) An exhaust orifice communicating with the cooling space wherein as the rotary vane is rotated a first of the plurality of vanes extends outwardly under centrifugal acceleration such that the distal leading edge of a first of the plurality of vanes abuts the internal circumferential surface of the internal pump chamber and dividing the internal pump chamber into a first abbreviated crescent shaped working space in communication with the inlet and as the rotary vane continues to rotate a second of the plurality of vanes extends outwardly under centrifugal acceleration such that the distal leading edge of the second of the plurality of vanes abuts the internal circumferential surface of the internal pump chamber and the internal pump chamber is subsequently divided into a second abbreviated crescent shaped working space defined between the first of the plurality of vanes and the second of the plurality of vanes, the at least one outlet fluidly communicating with the second abbreviated crescent shaped working space.

2. The vacuum pump assembly of claim 1 wherein the vacuum pump body defines a second internal chamber adjacent to and fluidly communicating with the internal pump chamber through the at least one outlet, the second internal chamber fluidly communicating with the cooling space.

3. The vacuum pump assembly of claim 2 wherein the vacuum pump body further comprises a first mounting surface, the first mounting surface abutting the rotary power source, the cooling space defined between the first mounting surface and the rotary power source.

4. The vacuum pump assembly of claim 3 wherein the first mounting surface further comprises at least one recirculation orifice fluidly communicating with the second internal chamber and the cooling space.

5. The vacuum pump assembly of claim 4 wherein the rotary power source further comprises a raised proximal perimeter rim projecting from a proximal end of the rotary power source that abuts the vacuum pump body and having an internal circumferential wall, the internal circumferential wall and the proximal surface further defining the cooling space between the vacuum pump body and the rotary power source.

6. The vacuum pump assembly of claim 5 wherein the mounting surface includes the exhaust orifice.

7. The vacuum pump assembly of claim 6 wherein the rotary power source further comprises a proximal surface having at least one cooling port, the at least one cooling port fluidly communicating with an internal structure of the rotary power source.

8. The vacuum pump assembly of claim 7 wherein the vacuum pump body further comprises a shaft bore located at a position concurrent with the rotation axis of the rotary vane, the shaft bore rotatably receiving the rotating shaft of the rotary power source.

9. The vacuum pump assembly of claim 8 wherein the rotary power source is an electric motor having an internal armature structure.

10. The vacuum pump assembly of claim 9 wherein the vacuum pump body further includes a support pedestal.

11. The vacuum pump assembly of claim 10 wherein the inlet further comprises a check valve.

12. The vacuum pump assembly of claim 11 further comprising an inlet valve fluidly communicating with the inlet, the inlet valve operable to engage and disengage the inlet from fluid communication with an external system.

13. The vacuum pump assembly of claim 12 wherein the inlet further comprises filtering means.

14. The vacuum pump assembly of claim 13 wherein the electronics housing further comprises at least one of a control panel, an instrument panel, a relay, and a terminal block.

15. A vacuum pump assembly comprising:

a) A vacuum pump body, the vacuum pump body defining a cylindrical internal pump chamber having a first circular wall and an opposed second circular wall separated by an axial width and an internal circumferential surface, the vacuum pump body defining a second internal cavity adjacent the cylindrical internal pump chamber, the vacuum pump body having a shaft bore extending between the cylindrical internal pump chamber and the second internal cavity;

b) A rotary vane having a cylindrical hub having an axial width and a plurality of outwardly projecting slots, each of the plurality of outwardly projecting slots slidably receiving a corresponding one of a plurality of vanes, each of the plurality of vanes having a distal leading edge having the same width as the axial width of the cylindrical internal pump chamber and the axial width of the rotary vane, the rotary vane rotatable about a rotation axis that is radially removed from the central axis of the cylindrical internal pump chamber;

c) An inlet, the inlet including a check valve and fluidly communicating with the cylindrical internal pump chamber;

d) At least one outlet, the at least one outlet connecting the cylindrical internal pump chamber in fluid communication with the second internal cavity;

e) A rotary power source abutting the vacuum pump body and fluidly communicating with the second internal chamber by way of a cooling space defined between the vacuum pump body and the rotary power source; the rotary power source having a rotating shaft, the rotating shaft extending along the rotation axis and received in the shaft bore and operably connected to the rotary vane;

f) An exhaust orifice, the exhaust orifice extending through the vacuum pump body and connecting the cooling space and the external environment in fluid communication; and g) An electronics housing positioned adjacent the vacuum pump body wherein as the rotary vane is rotated a first of the plurality of vanes extends outwardly under centrifugal acceleration such that the distal leading edge of a first of the plurality of vanes abuts the internal circumferential surface of the internal pump chamber thereby dividing the internal pump chamber into a first abbreviated crescent shaped working space in communication with the inlet and as the rotary vane continues to rotate a second of the plurality of vanes extends outwardly under centrifugal acceleration such that the distal leading edge of the second of the plurality of vanes abuts the internal circumferential surface of the internal pump chamber and the internal pump chamber is subsequently divided into a second abbreviated crescent shaped working space defined between the first of the plurality of vanes and the second of the plurality of vanes, the at least one outlet fluidly communicating with the second abbreviated crescent shaped working space.

16. The vacuum pump assembly of claim 15 wherein the vacuum pump body further comprises a first mounting surface, the first mounting surface abutting the rotary power source, the cooling space defined between the first mounting surface and the rotary power source.

17. The vacuum pump assembly of claim 16 wherein the first mounting surface further comprises at least one recirculation orifice fluidly communicating with the second internal chamber and the cooling space.

18. The vacuum pump assembly of claim 16 or claim 17 wherein the rotary power source further comprises a raised proximal perimeter rim projecting from a proximal end of the rotary power source that abuts the vacuum pump body and having an internal circumferential wall, the internal circumferential wall and the proximal surface further defining the cooling space between the vacuum pump body and the rotary power source.

19. The vacuum pump assembly of claim 18 wherein the mounting surface includes the exhaust orifice.

20. The vacuum pump assembly of claim 19 wherein the rotary power source further comprises a proximal surface having at least one cooling port, the at least one cooling port fluidly communicating with an internal structure of the rotary power source.

21. The vacuum pump assembly of claim 20 wherein the rotary power source is an electric motor having an internal armature structure.

22. The vacuum pump assembly of claim 21 wherein the vacuum pump body further includes a support pedestal.

23. The vacuum pump assembly of claim 22 further comprising an inlet valve fluidly communicating with the inlet, the inlet valve operable to engage and disengage the inlet from fluid communication with an external system.

24. The vacuum pump assembly of claim 23 wherein the inlet further comprises filtering means.

25. The vacuum pump assembly of claim 24 wherein the electronics housing further comprises at least one of a control panel, an instrument panel, a relay, and a terminal block.

* * * * *